US010065077B2

(12) United States Patent
Phillips

(10) Patent No.: US 10,065,077 B2
(45) Date of Patent: Sep. 4, 2018

(54) CLIMBING AID

(71) Applicant: Metolius Mountain Products, Inc., Bend, OR (US)

(72) Inventor: Douglas Phillips, Bend, OR (US)

(73) Assignee: Metolius Mountain Products, Inc., Bend, OR (US)

( * ) Notice: Subject to any disclaimer, the term of this patent is extended or adjusted under 35 U.S.C. 154(b) by 0 days.

(21) Appl. No.: 15/478,272

(22) Filed: Apr. 4, 2017

(65) Prior Publication Data

US 2018/0001144 A1 Jan. 4, 2018

Related U.S. Application Data

(60) Provisional application No. 62/356,683, filed on Jun. 30, 2016.

(51) Int. Cl.
*A63B 29/02* (2006.01)

(52) U.S. Cl.
CPC ..... *A63B 29/02* (2013.01)

(58) Field of Classification Search
CPC ..... A63B 29/02
See application file for complete search history.

(56) References Cited

U.S. PATENT DOCUMENTS

D58,730 S * 8/1921 Duda ..... D11/93
2,985,480 A * 5/1961 Otley ..... B66C 1/18 105/354
3,592,502 A * 7/1971 Bolliger ..... B66C 1/18 294/152
4,045,072 A * 8/1977 Brown ..... B66C 1/18 294/74
7,036,780 B1 * 5/2006 Geninatti ..... A63B 29/02 114/230.1
D733,525 S * 7/2015 Petzl ..... D8/349
D747,176 S * 1/2016 Petzl ..... D8/349
9,468,809 B2 * 10/2016 Coursimault ..... A63B 29/02
2010/0327615 A1 * 12/2010 Juan Ponsa ..... B66C 1/18 294/74

* cited by examiner

*Primary Examiner* — David M Upchurch
(74) *Attorney, Agent, or Firm* — Hancock Hughey LLP

(57) ABSTRACT

A climbing quickdraw is defined by first and second carabiners interconnected by looped webbing that has been overlapped and stitched to define a central, interconnecting portion that has four layers, and carabiner openings that are double layered. The length of webbing is formed in a loop such that the webbing is doubled over on itself until the ends are almost even with each other but not overlapping. The loop is then pressed flat so that the splice is near the center of the flattened loop and the webbing is four layers thick. The webbing is then securely sewn through all four layers on both sides of the splice, leaving an open loop at each end for attaching a carabiner. The new quickdraw can be made from woven webbing or from braided webbing. Braided webbing can be made of stretchy, energy absorbing nylon, giving the quickdraw energy absorbing properties. The braided webbing will also have mechanical properties that will allow it to stretch and absorb energy.

20 Claims, 5 Drawing Sheets

CLIMBING AID

TECHNICAL FIELD

The present invention relates to protective and safety anchoring systems used in the fields of climbing, sailing, rescue operations, etc. and more particularly to an improved climbing aid of the type known as a quickdraw or sling.

BACKGROUND

A quickdraw is a type of climbing equipment that comprises two carabiners that are connected by a sewn loop of webbing. While there are numerous variations on the basic quickdraw device that are available on the market, all are used to allow a climber to attach a climbing rope to a bolt or other protection while allowing the rope to run freely. In use, one of the carabiners of the quickdraw is clipped to a bolt (or other protection). The rope is then run through the other of the two carabiners.

Typically, woven nylon webbing is used to connect the two carabiners. The fabric is formed into a loop by circling a length of webbing over itself and so that the loop has a double layer of webbing. The ends of the length of webbing are overlapped and the loop is sewn together with stitching such as, traditionally, bar tacking, resulting in a closed loop having at least a portion of the webbing in a double, even triple layer. The bar tacking defines openings on both ends of the loop—the carabiners are attached to the loops.

The woven fabric used in quickdraws is strong and meets the applicable standards developed for equipment used in climbing. However, the webbing used in conventional quickdraws can wear over time, making routine inspection important.

Quickdraws are often used in indoor climbing gyms. In these uses, the quickdraw is often clipped onto the protection with a locking carabiner and the device is left in place on the climbing wall. Because the device remains on the wall for an indefinite period of time and is possibly subject of less frequent inspection, there is a need for a quickdraw that is strong and less prone to wear than conventional quickdraws.

The present invention is a quickdraw device in which the strength of the webbing has been increased by the specific manner in which the webbing is looped and sewn. Surprisingly, it has been discovered that by adding another layer to the fabric in the loop and by arranging the ends of the webbing in a specific arrangement, the fabric to fabric strength of the webbing is substantially increased. Thus, in the present invention the length of fabric in each loop is overlapped so that the entire loop is defined by four-layered webbing with double-layers of webbing where the carabiners contact the quickdraw, and where the opposite ends of the webbing do not overlap.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF ILLUSTRATED EMBODIMENTS

Figure 1:
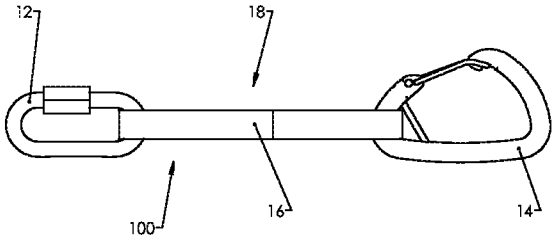
Fig. 1 Prior Art
FIG. 1 is a plan view of quickdraw according to the prior art in which the fabric loop is conventional.
Figure 2:
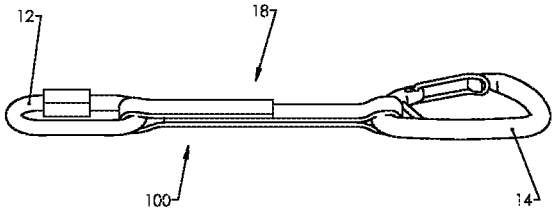
Fig. 2 Prior Art
FIG. 2 is perspective view of the prior art quickdraw shown in FIG. 1, illustrating the double layers of the fabric loop between the carabiners and the single layer loop around the carabiners.

A prior art quickdraw 100 is shown in FIGS. 1 and 2. Quickdraw 100 is defined by a first carabiner 12, a second carabiner 14, and a fabric loop 16 that interconnects between the two carabiners as shown. The fabric loop 16 shown in FIGS. 1 and 2, and the manner in which it is sewn are conventional, as are the carabiners 12 and 14. In FIG. 1 carabiner 12 is a threaded, locking carabiner of the quick link type that is often used in indoor climbing gyms since the carabiner 12 may be attached to a bolt and left in place for an extended period of time. The opposite carabiner 14 is a conventional closed eye carabiner. Many different types of carabiners are used with quickdraws and the present invention may be used with any number of carabiner types.

In the prior art, the fabric loop 16 is defined by a length of webbing that has its opposite ends overlapped and sewn together to define the two carabiner-attachment loops through which the carabiners are attached. Notably, there is only a single layer of webbing in the loops where the carabiners attach to the fabric loop and three layers of webbing where the opposite ends of the webbing overlap.

Figure 3:
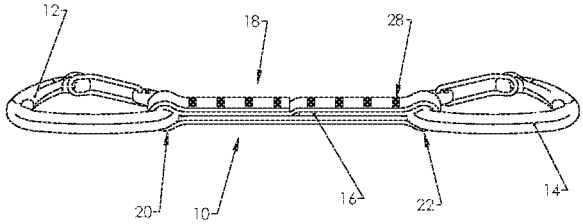
FIG. 3 is perspective view of a first illustrated embodiment of a quickdraw according to the present invention.
Figure 6:
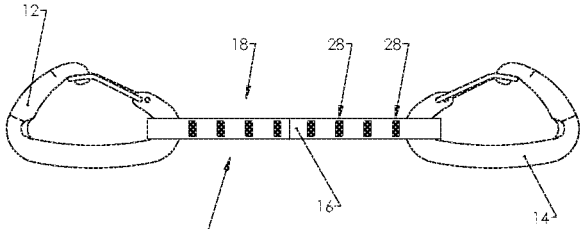
FIG. 6 is a plan view of the quickdraw according to the present invention illustrated in FIG. 3.

A first embodiment of a quickdraw 10 according to the present invention is shown in FIGS. 3 through 6. Quickdraw 10 is defined by a first carabiner 12, a second carabiner 14, and a fabric loop 16 that interconnects between the two carabiners as shown. The present invention comprises the fabric loop 16 and the manner in which it is sewn; again, the carabiners are conventional. In FIGS. 3 and 6 the carabiners 12 and 14 are conventional non-locking carabiners but they could be replaced by locking carabiners of type shown in FIGS. 1 and 2. Again, many different types of carabiners are used with quickdraws and the present invention may be used with any number of carabiner types.

Figure 4:
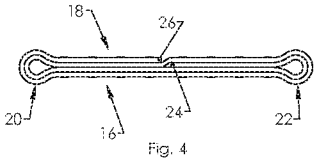
FIG. 4 is a side elevation view of the fabric loop used in the quickdraw of FIG. 3, but with the carabiners removed to better illustrate the structure of the invention.
Figure 5:
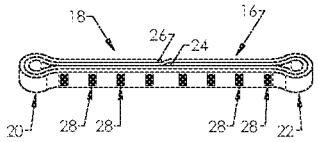
FIG. 5 is a perspective view of the fabric loop shown in FIG. 4.

With continuing reference to FIGS. 3 through 6, it may be seen that fabric loop 16 is a length of woven webbing that is circled over itself and sewn to define a multilayered loop that is stitched in its center portion 18 to define carabiner openings 20 and 22 at opposite ends of the loop for the carabiners 12 and 14. The overlapping layers of webbing that define loop 16 are best shown in FIG. 4. The first end of the webbing is identified with reference number 24—the first end is located near the center of the loop and is, in the finished loop 16, in the interior of the layers of the webbing. The length of webbing is circled over itself so that there are 4 layers of webbing in the center portion 18 and 2 layers of webbing in each of the openings 20 and 22. The second end of the webbing, identified with reference number 26, is at the outermost layer in the center portion 18 and is positioned so that it does not overlap with the position of the first end 24 but would be butting against end 24 (if the first and second ends were in the same layer).

The fabric loop 16 is defined by a length of webbing that is formed in a loop such that the webbing is doubled over on itself until the ends 24 and 26 are almost even with each other but not overlapping. The loop 16 is pressed flat so that the splice—that is, the region of in the central portion 18 where the facing first and second ends 24 and 26 meet is near the center of the flattened loop—in central portion 18—and the webbing is four layers thick throughout the central portion 18. The thus-oriented webbing is then securely sewn through all four layers on both sides of the splice, leaving the openings 20, 22 at each end of the fabric loop 16 for attaching a carabiner, 12 and 14. The sewing is conventional: the webbing is sewn together longitudinally with conventional sewing techniques—the longitudinal stitching is not visible in the drawings to better illustrate the types of stitching that may be used to interconnect the layers of fabric. As noted above, bar tacks are one traditional type of stitching that may be used and in the drawings plural bar tacks 28 are sewn into the center portion 18 and the bar tacks define the openings 20 and 22. It is to be understood that instead of bar tacking computer driven pattern stitching may be used to stitch the layers together in center portion 18 and the stitching may be in any particular pattern that is programmed into the sewing machines. Even with computer driven patterns, the traditional "appearance" of bar tacking may be beneficial because consumers tend to recognize the traditional bar tacking patterns and thus have confidence in the product even though other, computer driven patterns are functionally and operationally superior in many cases. The longitudinal stitching is done prior to the bar tacking, and helps to keep the layers from separating, especially in the openings 20 and 22. This helps prevent inadvertent insertion of a carabiner through only one layer of webbing in the openings.

The fabric used to form loop 16 may be conventional woven nylon webbing that is used in climbing applications. The webbing may beneficially incorporate or comprise the high-strength ultra-high molecular weight polyethylene fibers.

A quickdraw 10 formed as shown in the drawings and as described above has unexpectedly high strength. The specific arrangement of the webbing to define a central portion 18 that has 4 layers of webbing is the reason for the surprisingly high strength of the quickdraw.

Figure 7:
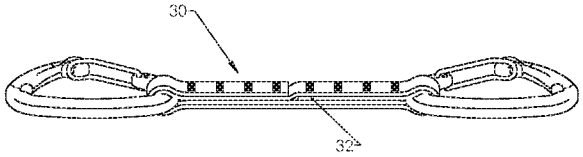
FIG. 7 is a perspective view of another embodiment of a quickdraw according to the present invention in which braided rather than woven fabric is used to form the loops.

Turning to the embodiment of FIG. 7, a quickdraw 30 is shown and is constructed in the same manner as quickdraw 10 described above. However, the fabric loop 32 is defined by braided nylon fabric rather than woven nylon. The braided nylon is tubular and similar to the braided nylon that is used in the outer sheath of kernmantle-type climbing ropes. The tubular form is flattened when the loop 32 is sewn as shown in FIG. 7. The tubular braided webbing will also have mechanical properties that will allow it to stretch and absorb energy. Thus, using tubular braided nylon for the fabric loop 32 provides resiliency and stretch that cannot be obtained with woven nylon webbing yet affords the necessary strength for use in quickdraws.

The quickdraw 10 according to the present invention has been tested and results show that the breaking strength for the quickdraw as claimed herein is about 1.3 to 1.4 times greater than the breaking strength of a conventional quickdraw having a single wrap as shown in FIGS. 1 and 2, yet the weight of the quickdraw 10 according to the invention is about 1.5 times the weight of a conventional quickdraw. As such, the incremental increase in weight will not be objectionable to most climbers given the increase in breaking strength.

The internationally accepted minimum breaking strength for a climbing sling such as a quickdraw 10 is 22 kn. A conventional quickdraw manufactured by the assignee of the present application (Metolius Mountain Products, Inc.) typically breaks at 26 to 27 kn; a 15% margin of extra strength is preferred for a safety margin. A quickdraw 10 according to the present invention, fabricated with the same webbing in the double wrap configuration as specified herein breaks at 36 to 37 kn. When a quickdraw fails in the field, it is typically because of age, wear, and abrasion. It is possible for a quickdraw to look old with some frayed fibers, but still be intact and appear to be reasonable to use, and yet be unsafe. The double wrap construction described herein and as shown in the drawings makes it much more difficult to have a situation where the sling looks usable but is actually unsafe.

Another advantage is that the double wrap sling according to the present invention will meet the 22 Kn standard if the outer wrap is completely destroyed by abrasion, cutting or UV light damage.

One more advantage of the quickdraw 10 according to the present invention is that with conventional quickdraw slings it is desirable to have a narrow sling profile at the end of the sling where the carabiner sits. Several prior art single wrap slings use a variable width webbing to accomplish this—the webbing is woven such that the main body of the quickdraw, for example at center portion 18, is 18 mm wide, then the webbing tapers down to 13 mm wide where it turns the corner where the carabiner attaches, then gets wider again for the main body. With the double wrap quickdraw 10 according to the invention described herein, this differential width webbing is not necessary and it is possible to use webbing that has the same width throughout the loop 16.

Figure 8:
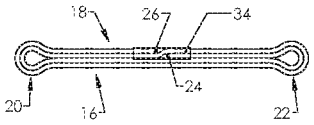
FIG. 8 is a side elevation view of the quickdraw according to the present invention and in which a label covers the exposed ends of the webbing.

Reference is now made to the quickdraw 10 that is shown in FIG. 8. The embodiment shown in FIG. 8 is identical to that shown in FIG. 4 except a cover 34 is shown attached to the quickdraw such that the cover extends over both of the first and second ends, 24 and 26, of the webbing. In normal practice the webbing that forms loop 16 is "hot cut" from a long roll of webbing—the hot cutting process defines the length of webbing that is used to form loop 16 and of course the two ends 24 and 26. Hot cutting necessarily melts the webbing material in order to cut it, and usually results in the molten material drying into hardened and sometimes jagged surfaces the ends 24 and 26. In use it is very common for a climber to grab the quickdraw 10 when climbing a difficult route. In a prior art quickdraw such as that shown in FIGS. 1 and 2, the hot cut end is exposed and the jagged hot cut end can be very uncomfortable to the climber's hand. This applies not only to the outer end shown in FIG. 1, but also to the internal end shown in FIG. 2 because the hot cut edges are still exposed at the side of the loop 16. With a prior art quickdraw such as those in FIGS. 1 and 2, it is impractical to cover both of the exposed ends because they are spaced apart, as shown.

Returning to FIG. 8, the first and second ends 24 and 26 are positioned in loop 16 so that they would be butting (as described above) if they were in the same layer. Accordingly, a cover 34 is sewn onto the webbing such that the cover extends over both of the ends 24 and 26 to thereby occlude the hot cut ends and eliminate the jagged surfaces of those ends. The cover 34 shown in FIG. 8 is shown as being transparent in order to show the underlying structures such as first and second ends 24 and 26. Moreover, in the elevation view of FIG. 8 neither the upper side of the webbing, nor the opposite side, are visible. It will be understood that the cover 34 extends over the upper side and the opposite side in the same way that it is visible in FIG. 8. The cover 34 may be a fabric piece that is sewn onto the webbing and which includes indicia such as brand names or logos, but which functionally occludes the hot cut ends for the purpose of adding comfort. The cover 34 may extend only partially around the webbing of loop 16 as shown in order to cover both of the first and second ends, or may completely encircle the webbing.

While the present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. In a climbing aid of the quickdraw type and having first and second carabiners interconnected by webbing loop, the improvement comprising:

said webbing loop defined by a length of fabric having first and second opposed ends, the length of fabric formed into a loop and stitched at a central portion to define a multi-layered loop having carabiner openings at opposite ends, wherein there are at least 2 layers of webbing in each of the carabiner openings and at least 4 layers of webbing at the central portion, wherein the first end of the fabric is positioned in the central portion and is at the end of the length of fabric that forms at least a portion of an outer layer of the loop; and a cover extending over the first end of the fabric.

2. The improvement according to claim 1 wherein the second end of the fabric is positioned in the central portion but does not overlap the first end, and the second end of the fabric is in an intermediate layer.

3. The improvement according to claim 2 in which the cover extends over the second end of the fabric.

4. The improvement according to claim 3 wherein the cover occludes the first end of the fabric.

5. The improvement according to claim 1 wherein the fabric has consistent width along the entire length of the fabric.

6. The improvement according to claim 1 wherein the fabric is a tubular braid.

7. The improvement according to claim 1 wherein the quickdraw has a breaking strength of at least about 36 kn.

8. A climbing aid, comprising:

a first carabiner;

a second carabiner;

a fabric loop interconnecting the two carabiners, the fabric loop defined by a length of webbing having first and second opposed ends and formed into an overlapping double-layered circle, and the layers of fabric interconnected with stitching at a center portion to define a four-layered center portion and double-layered first and second openings at opposed ends of the fabric loop, wherein the first end is positioned in the center portion at an outer layer, wherein the first carabiner is attached to the fabric loop at the first opening and the second carabiner is attached to the fabric at the second opening, and a cover extending over the first end.

9. The climbing aid according to claim 8 where the fabric loop is stitched longitudinally along the center portion.

10. The climbing aid according to claim 9 wherein the first end of the webbing is positioned in the central portion in an outer layer of fabric and the second end of the webbing is positioned in the central portion in an intermediate layer of fabric, and wherein the second end does not overlap the first end.

11. The climbing aid according to claim 8 wherein the cover extends over the second end of the webbing.

12. The climbing aid according to claim 11 wherein the cover occludes the first and second opposed ends of the webbing.

13. The climbing aid according to claim 8 wherein the webbing has consistent width along the entire length thereof.

14. The climbing aid according to claim 13 wherein the webbing is a tubular braid.

15. A climbing aid, comprising:

a first carabiner;

a second carabiner;

a fabric loop interconnecting the two carabiners, the fabric loop defined by a length of webbing having first and second opposed ends and formed into an overlapping elongate member having opposed ends with a first carabiner attachment loop at one end and a second carabiner attachment loop at the opposite end, wherein each of the first and second carabiner attachment loops is defined by at least two layers of fabric, wherein the first end of the length of webbing is positioned along an outer layer of fabric between the first and second carabiner attachment loops, and a cover extending over the first end.

16. The climbing aid according to claim 15 further comprising the fabric loop having a center portion between the first and second carabiner attachment loops and wherein there are four layers of fabric interconnected with stitching at the center portion.

17. The climbing aid according to claim 16 wherein the first end of the fabric is positioned in the central portion and the second end of the fabric is positioned in the central portion but does not overlap the first end.

18. The climbing aid according to claim 17 including a cover extending over the first and second ends of the fabric.

19. The climbing aid according to claim 18 wherein the cover occludes the first and second opposed ends of the fabric.

20. The climbing aid according to claim 19 wherein the fabric is a tubular braid.

* * * * *